US008337003B2

(12) United States Patent
Hsu et al.

(10) Patent No.: US 8,337,003 B2
(45) Date of Patent: Dec. 25, 2012

(54) CATCHER INCLUDING DRAG REDUCING DROP CONTACT SURFACE

(75) Inventors: Chang-Fang Hsu, Beavercreek, OH (US); Shan Guan, Dublin, OH (US)

(73) Assignee: Eastman Kodak Company, Rochester, NY (US)

( * ) Notice: Subject to any disclaimer, the term of this patent is extended or adjusted under 35 U.S.C. 154(b) by 366 days.

(21) Appl. No.: 12/504,050

(22) Filed: Jul. 16, 2009

(65) Prior Publication Data

US 2011/0012967 A1 Jan. 20, 2011

(51) Int. Cl.
*B41J 2/185* (2006.01)
*B41J 2/02* (2006.01)

(52) U.S. Cl. ..... 347/90; 347/73

(58) Field of Classification Search ..... 347/30, 347/36, 73, 77, 82, 89, 90
See application file for complete search history.

(56) References Cited

U.S. PATENT DOCUMENTS

| | | | | |
|---|---|---|---|---|
| 3,813,675 | A | 5/1974 | Steffy et al. | |
| 4,460,903 | A * | 7/1984 | Guenther et al. | 347/90 |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,513,918 | B1 * | 2/2003 | Faisst et al. | 347/73 |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,793,328 | B2 | 9/2004 | Jeanmaire | |
| 6,820,970 | B2 * | 11/2004 | Long | 347/73 |
| 6,827,429 | B2 | 12/2004 | Jeanmaire et al. | |
| 6,851,796 | B2 | 2/2005 | Jeanmaire et al. | |
| 6,962,411 | B2 * | 11/2005 | West et al. | 347/90 |

FOREIGN PATENT DOCUMENTS

EP 1 013 425 6/2000

* cited by examiner

*Primary Examiner* — Anh T. N. Vo
(74) *Attorney, Agent, or Firm* — William R. Zimmerli

(57) ABSTRACT

A catcher and a method of printing are provided. The catcher includes a liquid drop contact face. The liquid drop contact face includes an opening that creates an air cushion upon which liquid flows after a liquid drop contacts the drop contact face.

19 Claims, 9 Drawing Sheets

CATCHER INCLUDING DRAG REDUCING DROP CONTACT SURFACE

FIELD OF THE INVENTION

This invention relates generally to the field of digitally controlled printing devices, and in particular to catchers of continuous liquid jetting systems.

BACKGROUND OF THE INVENTION

Traditionally, inkjet printing is accomplished by one of two technologies referred to as "drop-on-demand" and "continuous" printing. In both, liquid, such as ink, is fed through channels formed in a print head. Each channel includes a nozzle from which droplets are selectively extruded and deposited upon a recording surface.

Continuous liquid printing uses a pressurized liquid source that produces a stream of drops some of which are selected to contact a print media while other are selected to be collected and either recycled or discarded. For example, when no print is desired, the drops (commonly referred to as non-print drops) are deflected into a capturing mechanism (commonly referred to as a catcher, interceptor, or gutter) and either recycled or discarded. When printing is desired, the drops (commonly referred to as print drops) are not deflected and allowed to strike a print media. Alternatively, deflected drops can be allowed to strike the print media, while non-deflected drops are collected in the capturing mechanism.

After the non-print liquid drop contacts the catcher, it flows down the catcher face. Drag causes the liquid to slow down which can cause the liquid layer (also referred to as a liquid film) to become thicker. Increasing the thickness of the liquid film reduces the clearance between the liquid film and the print drops. If there is insufficient clearance between the liquid film and the print drops, the ink film can contact the print drops resulting in print defects.

As such, there is an ongoing effort to improve catcher performance in continuous printing systems.

SUMMARY OF THE INVENTION

According to a feature of the present invention, a catcher for an inkjet printer includes a liquid drop contact face including an opening. The opening creates an air cushion upon which liquid flows after a liquid drop contacts the drop contact face. Advantageously, the catcher helps to reduce liquid film thickness and increase the print window of the printing system.

According to another feature of the present invention, a method of printing includes providing a jetting module including a nozzle in fluid communication with a liquid source; causing liquid to be jetted through the nozzle; causing liquid drops to be formed from the liquid that is jetted through the nozzle; deflecting at least some of the liquid drops using a deflection mechanism; providing a catcher including a liquid drop contact face, the liquid drop contact face including an opening; creating an air cushion using the opening of the drop contact face; and causing some of the liquid drops to flow along the air cushion after the liquid drop contacts the drop contact face while other drops are permitted to contact a print media.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
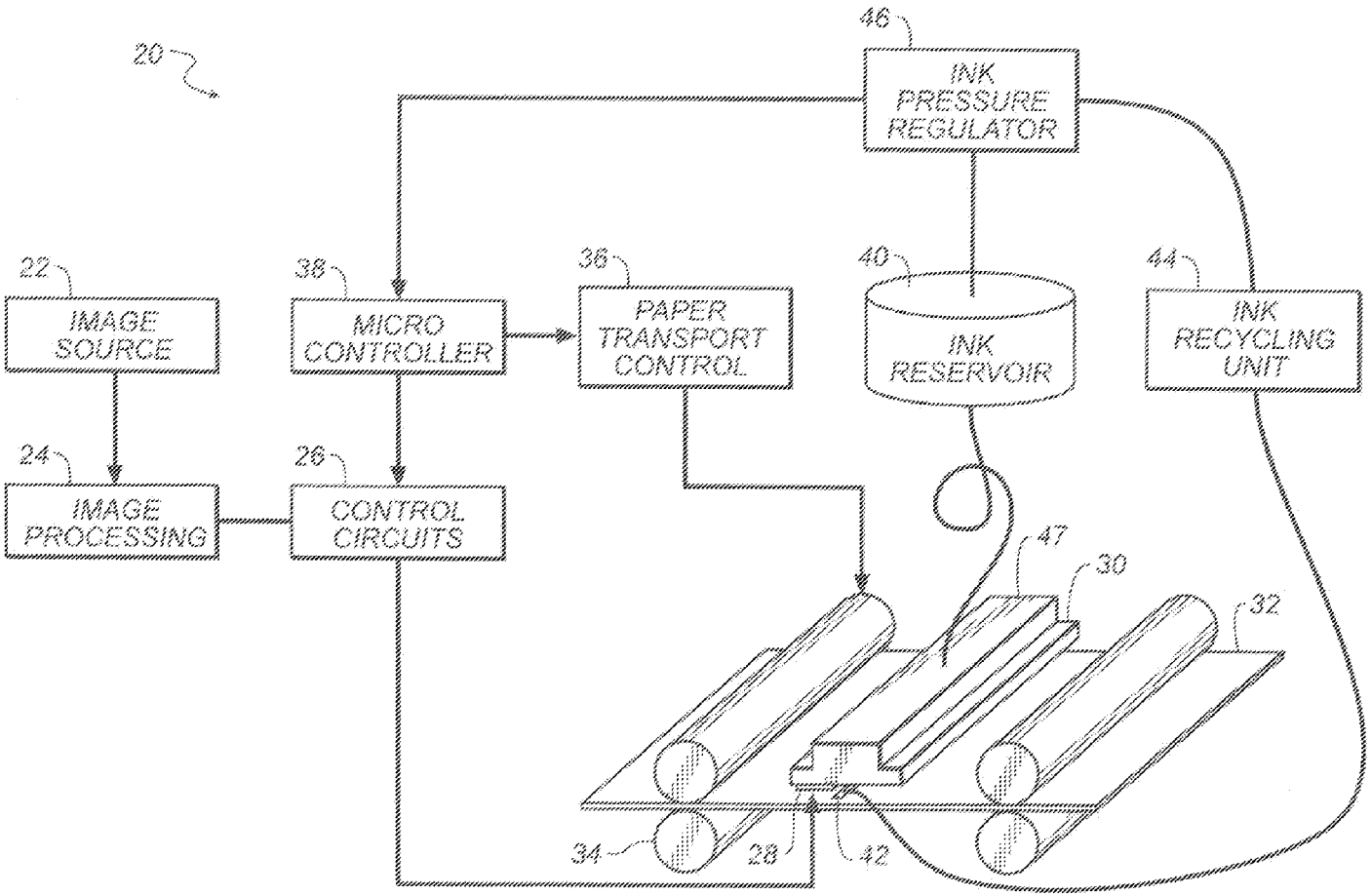
FIG. 1 shows a simplified block schematic diagram of an example embodiment of a printer system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous ink jet printer system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
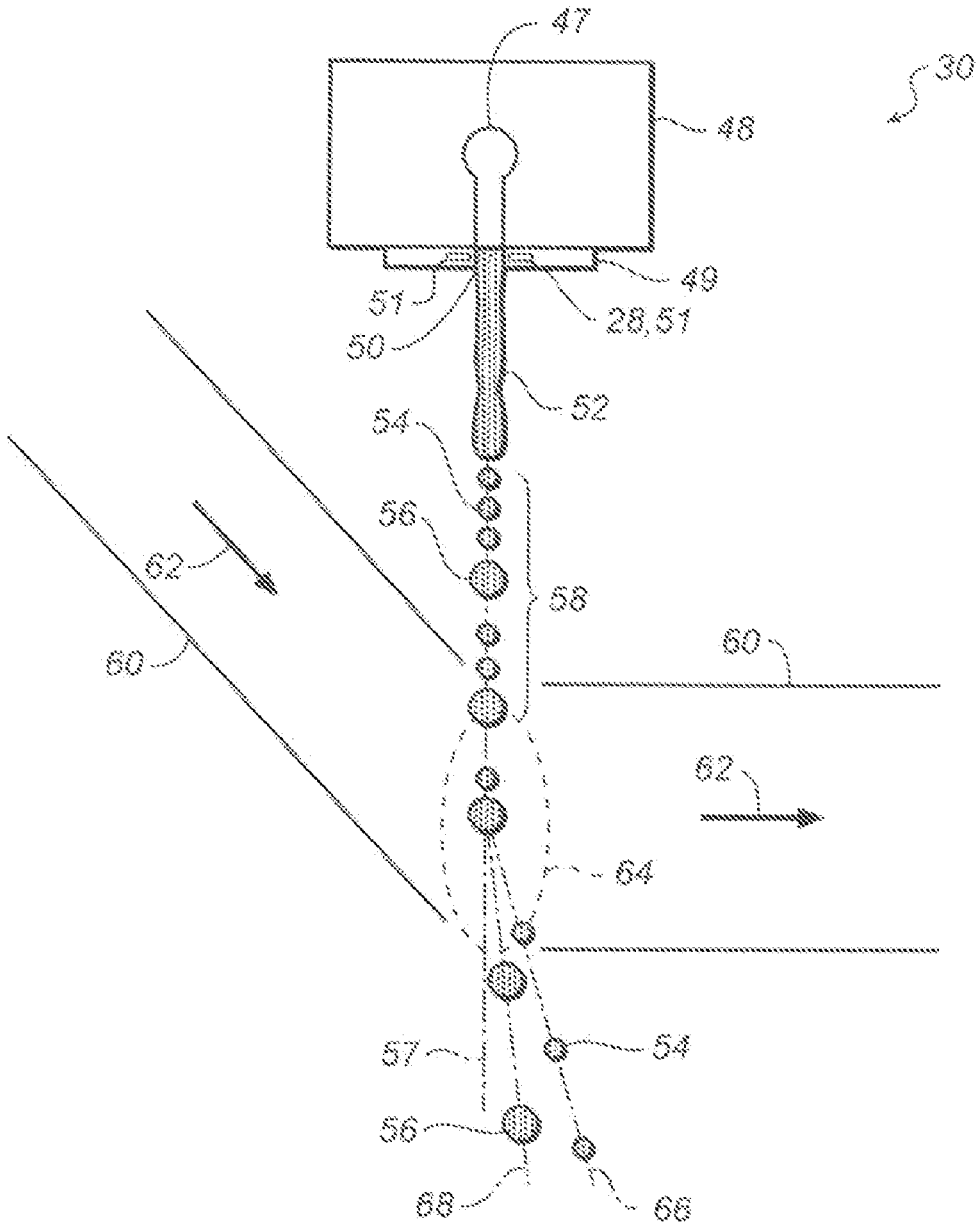
FIG. 2 is a schematic view of an example embodiment of a continuous printhead made in accordance with the present invention.
Figure 3:
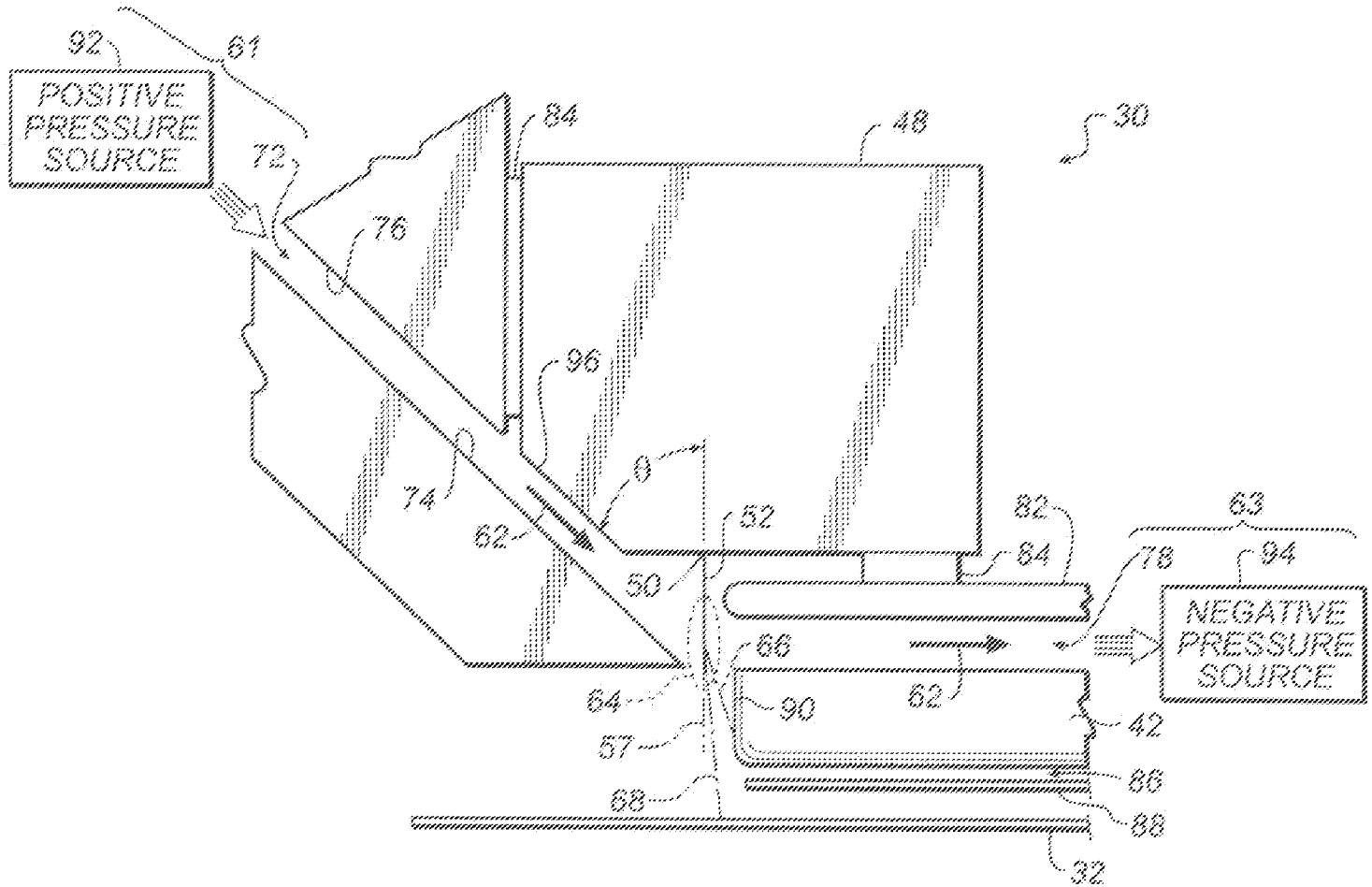
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size and liquid drops having a second size through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51 located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes, for example, in the form of large drops 56, a first size, and small drops 54, a second size. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas supplied from a positive pressure source 92 at downward angle θ of approximately a 45° toward drop deflection zone 64. An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. As shown in FIG. 3, catcher 42 is a type of catcher commonly referred to as a "Coanda" catcher.

The present invention is not limited to use with the specific drop deflection mechanism or drop forming mechanism described above. For example, an electrostatic deflection mechanism can be used in place of a gas flow deflection mechanism, and a piezoelectric drop forming device can be used in place of a thermal drop forming device. The particular mechanisms selected depend on the specific application contemplated.

Figure 4:
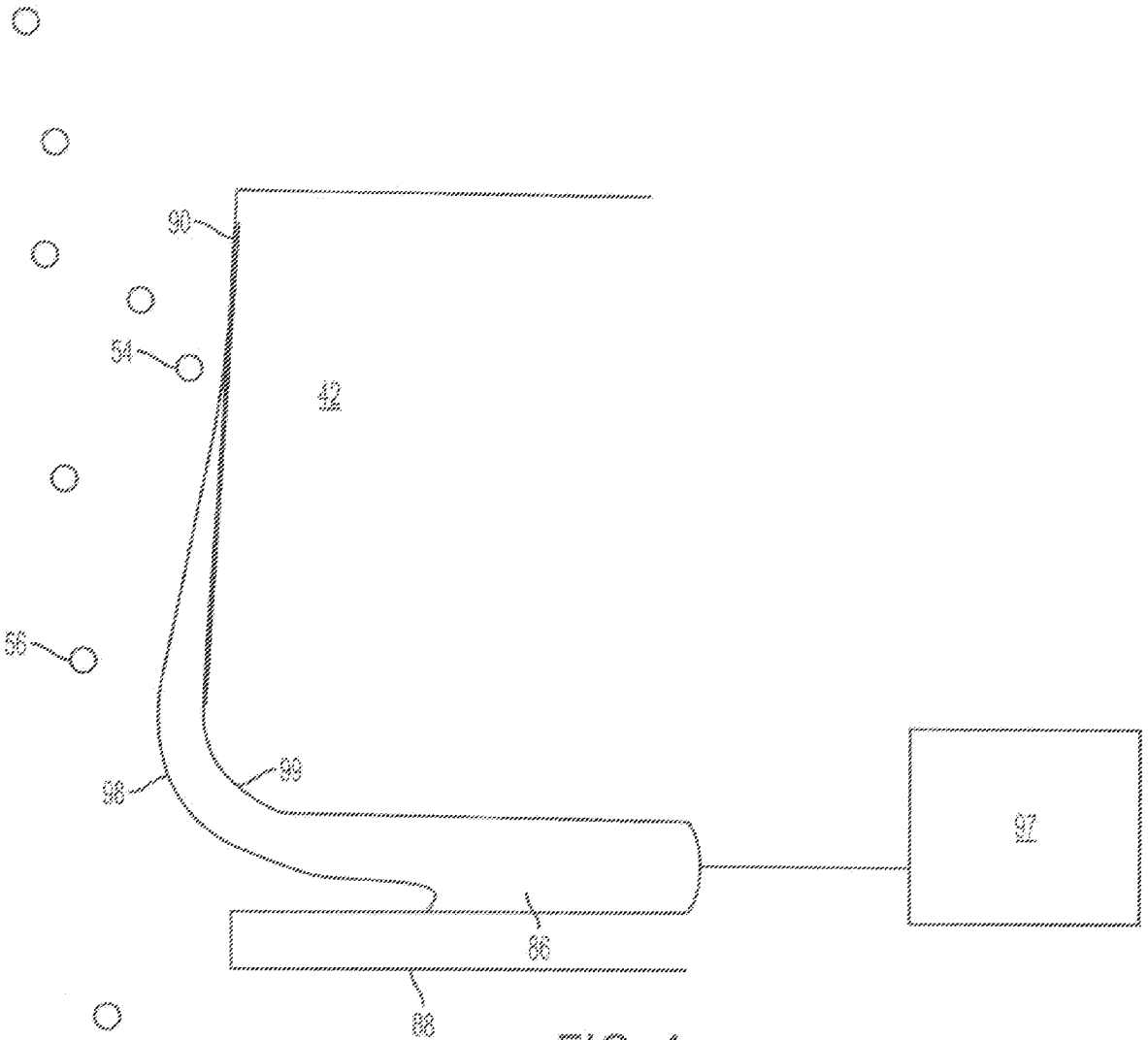
FIG. 4 is a schematic view of an example embodiment of a continuous printhead showing a catcher face that includes an air cushion formed by free standing pillars.

Referring to FIG. 4, the non-print drops 54 impinge on the front face 90 of the catcher 42. The liquid from these drops, still retaining the downward momentum of the drops, flows down the face toward the ink removal duct 86 either as individual rivulets of ink for drops from each jet or as a continuous film or sheet of ink spanning the whole array of jets. For simplicity, the ink layer whether in the form of individual rivulets or as a continuous film will be referred to as an ink film 98. Flow down the face of the catcher, as used in this application, is the liquid flow along the catcher face from the position at which the drops impinge the catcher face and move toward the liquid return duct 86, independent of the orientation of the printhead. The Coanda effect causes the liquid to stay attached to the surface of the catcher as it flows around the rounded edge 99 to flow into a liquid return duct 86 located or formed between catcher 42 and a plate 88. Ink entering the liquid return duct 86 is evacuated from there by means of a negative pressure source 97 and may be returned to the ink reservoir (not shown) for reuse or the ink can be disposed of.

As the ink flows down the catcher face 90, drag causes the liquid to slow down, which causes the layer of ink to become thicker. Increasing the thickness of the ink film 98, reduces the clearance between the ink film 98 and the print drops 56. If there is insufficient clearance between the ink film 98 and the print drops 56, the ink film can contact the print drops resulting in a defect in the print. The present invention helps to retain the clearance between the ink film and the print drops 56 by reducing the drag on the ink flowing down the catcher face 90.

Conventional techniques, see, for example, EP 1 013 425, reduced the fluid drag by heating the ink to lower its viscosity. Polishing or buffing the catcher face could reduce the fluid drag on the catcher face. While these methods reduce the fluid drag, the reduction in fluid drag is not sufficient for some printing applications, especially those involving high viscosity inks or smaller drop sizes.

Figure 5:
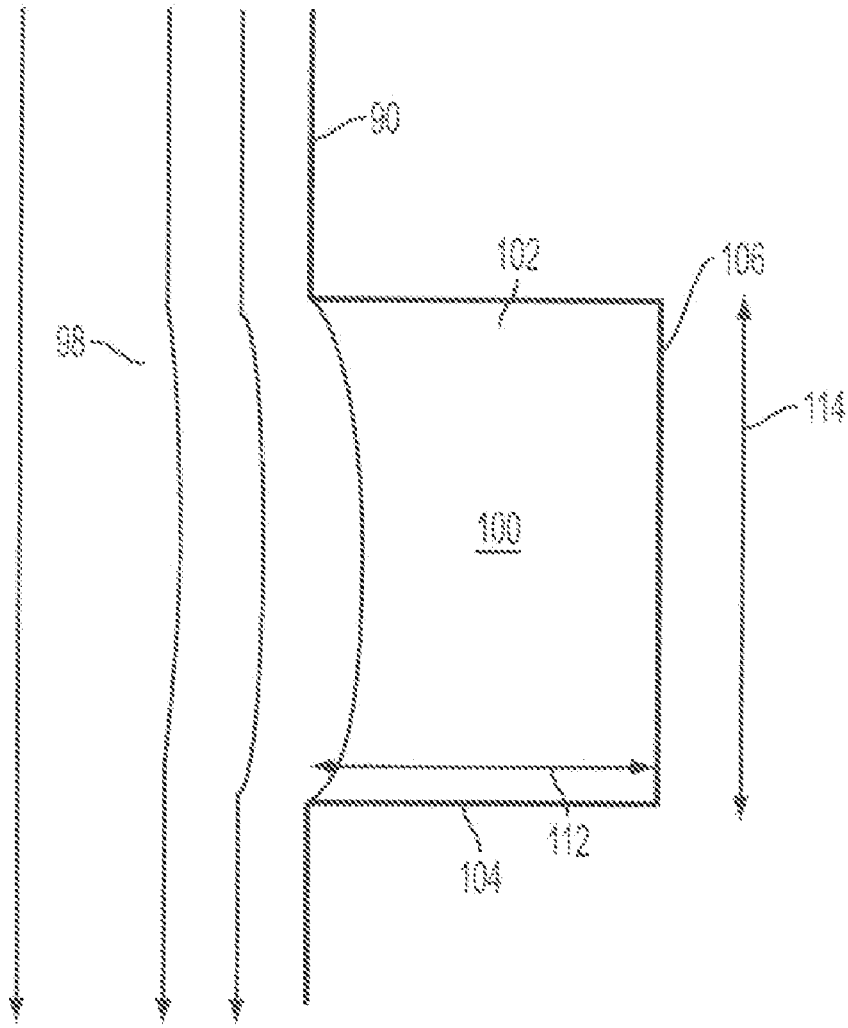
FIG. 5 is a schematic view showing liquid flow across a single opening of the catcher face.

To provide a reduction in the air drag, the catcher face 90 is fabricated to create a plurality of openings 100 into the face. FIG. 5 shows a cross section view of a single opening 100. Ink, flowing down the catcher face, passes over the opening and traps air in the opening. The air acts as an air cushion 102 or air bearing over which the liquid flows. The air bearing between the ink and the surface of the catcher allows the fluid to move with less drag as it flows down the catcher face 90. While the ink film 98 can partially enter the opening 100, the fluid does not flow through the opening 100. The reduced drag allows the ink film 98 to flow at a higher speed and reduces the thickness of the ink film.

The walls 104 and base 106 of the opening are preferably made from a material or coated with a material that is non-wettable by the ink or liquid used in the printhead. A non-wettable surface is one that has a contact angle between the liquid and surface of greater than 90°. Preferably, the approximate diameter of openings 100 is between 2 μm and ⅓ of the jet to jet spacing in the ink jet array (14 μm for a 600 jet per inch array). If the openings 100 are too shallow, turbulent flow can form between the fluid in the openings and the ink film on top that can dissipate flow momentum and reduce the ink film speed. Ideally, the opening 100 is deep enough that the ink flow does not flow into the opening 100 of the hydrophobic surface, but a cell flowing with a self-sustained vortex can be observed on the hydrophilic surface. The openings need to be deep enough to retain some air in the depression as liquid flows over the opening, but additional depth provides no further advantage. The depth 112 of the opening 100 should be at least about two times the diameter 114 of the opening 100. More preferably the depth 112 of the opening 110 is at least five times the diameter or width of the opening 100.

Figure 6:
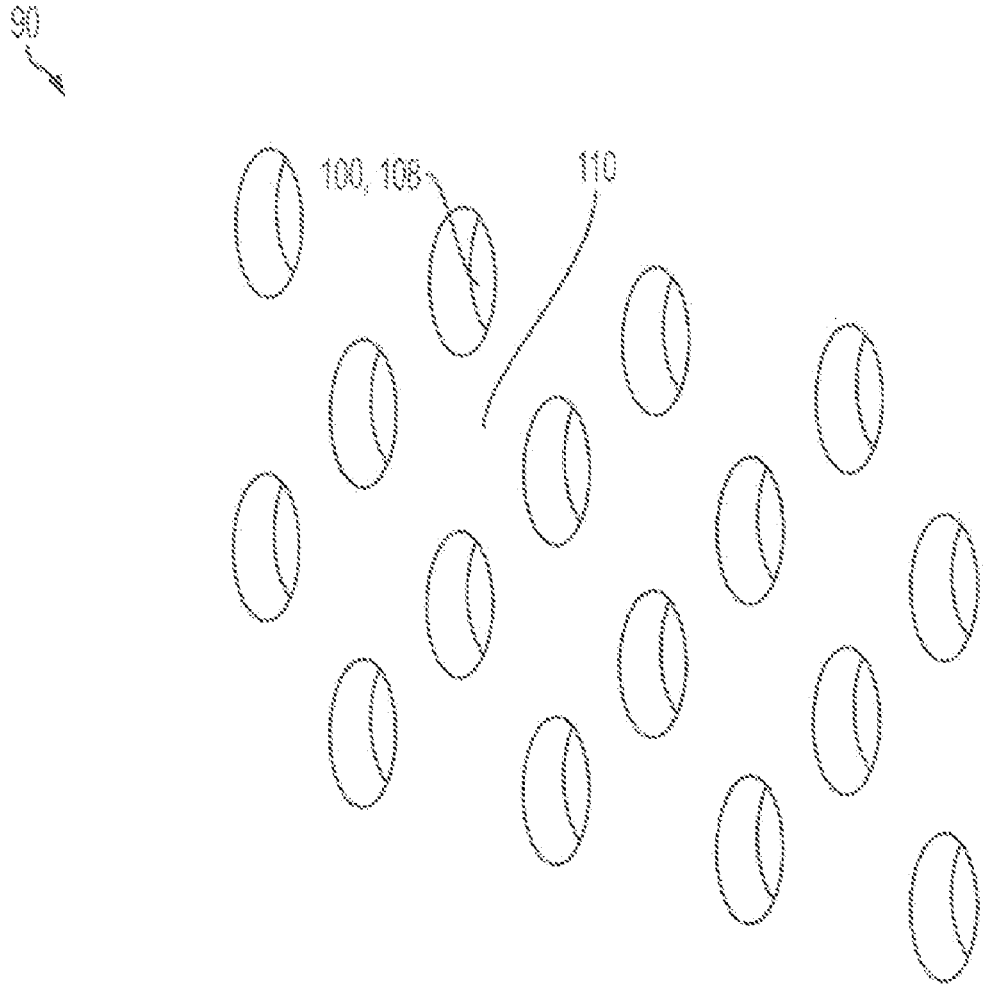
FIG. 6 is an isometric view of a portion of a catcher face with openings that are formed by depressions in the catcher face surface.

FIG. 6 is an isometric view of a portion of the catcher face 90 showing one embodiment of the openings 100. As shown, openings 100 comprise depressions 108 in the surface of plate 88. The depressions 108 can be arranged as a two-dimensional array of openings in an ordered array of columns and rows, or in staggered rows as shown in FIG. 6. Alternatively, the depressions 108 can be randomly spaced. As the liquid drag is reduced in front of an opening relative to the liquid drag in front of the land area 110 between openings, it is desirable to keep the land area 110 between openings to a minimum. Alternatively stated, as the liquid flows across the depressions that have less drag when compared to the raised portions 110 of the catcher face, it is desirable to maximize the ratio of the area of the depressions 108 to the area of the raised portions 110. Preferably, the amount of the area of the depressions is at least 10% of the land area between the depressions. More preferably, the amount of the area of the depressions is at least 50% of the land area between the depressions. Even more preferably the amount of the area of the depressions is equal to 100% of the land area between the depressions.

Figure 7:
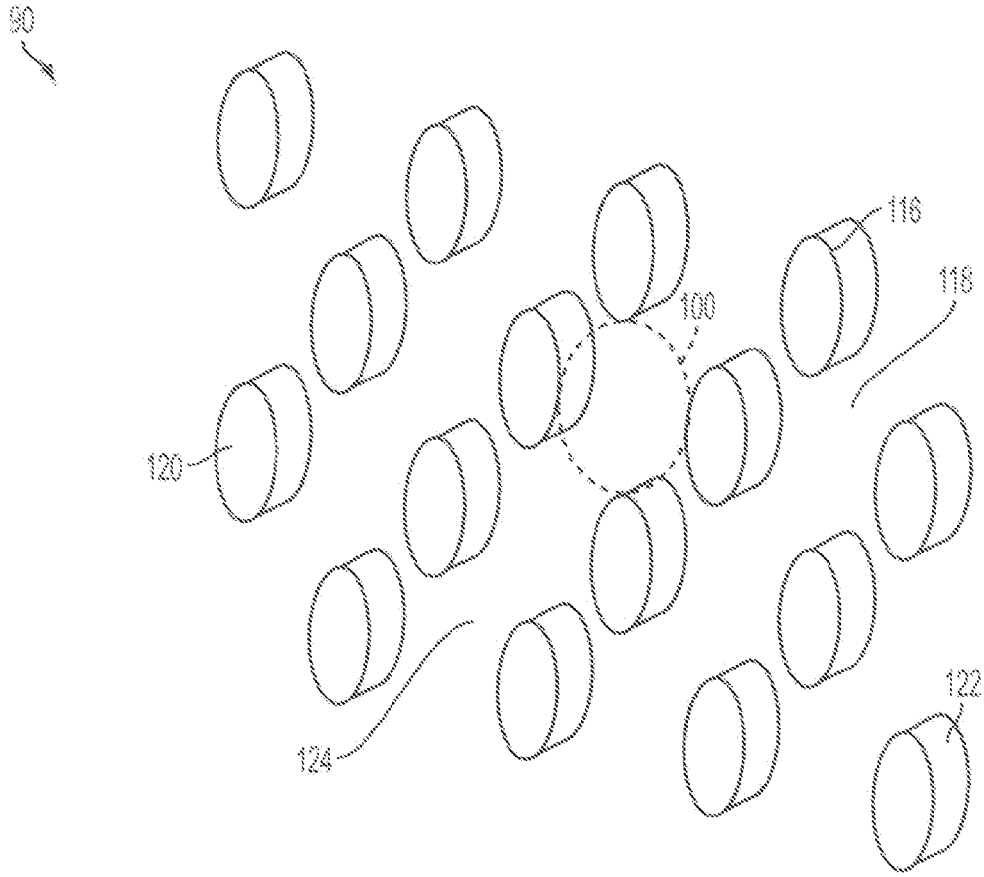
FIG. 7 is an isometric view of a portion of a catcher face with openings that are formed by the gaps between micropoles formed in the catcher face surface.

As shown in FIG. 7, an alternate embodiment for the creation the openings 100 comprises forming a closely spaced array of micro-poles (also referred to as free-standing pillars)

116, on the surface of catcher 90. The gaps 118 between the closely spaced micro-poles form openings 100 that can create air bearings upon which liquid flows after a liquid drop contacts the drop contact face. The ends 120 of micro-poles form the land area between the openings. The sides 122 of the micro-poles and the base surface 124 between the micro-poles should be hydrophobic for water based ink or in general non-wettable by the ink. When the micro-poles are closely spaced and the walls of the micro-poles are non-wettable, the surface tension of the ink keeps the ink from penetrating significantly in the gaps between micro-poles. Air, therefore, remains in the gaps to create the desired air cushion to reduce liquid drag.

The micro-poles 116 can be round posts, square posts, hexagonal posts, or any other shaped post suitable for the specific application contemplated. The aspect ratio between the overall surface of the pole and the impact surface of the pole is preferably greater than 20. Other aspect ratios can be used, depending on the specific application contemplated, provided that the fluid won't flow down between the poles where the base of the pole is made of a hydrophobic material and provided that the ink recirculation won't affect the flow of the fluid where the base of the pole is made of a hydrophilic material. The preferred pole (or pillar) width is between 2 and 5 μm, though other widths can be used provided the surface is large enough for the droplet to impact, but small enough to prevent splashing. Preferably, the approximate diameter of openings 100 between poles is between 2 μm and ⅓ of the jet to jet spacing in the ink jet array (14 μm for a 600 jet per inch array). The depth 112 of the openings 100 between poles should be at least about two times the diameter 114 of the opening 100. More preferably the depth 112 of the opening 110 is at least five times the diameter or width of the opening 100. Furthermore, the specific 2-D arrangement of micro-poles 116 on the surface of plate 88 can vary depending on the specific application contemplated, provided that neither the width of the pole nor the distance between neighboring poles is too large. As the poles are arranged in a 2-D manner, the openings, and therefore the air cushion, can be 2-D in nature, surrounding the free-standing pillars. The micro-poles 116 are preferably silicon nitride or silicon dioxide, though other materials can be used, provided they produce low drag and encourage the fluid to flow across the top of the pillars, or micro-poles 116, rather than into the opening. For example, any materials that can be micro-machined and are non-wettable to the ink are suitable for use. The specific materials used depend on the particular application contemplated.

Figure 8:
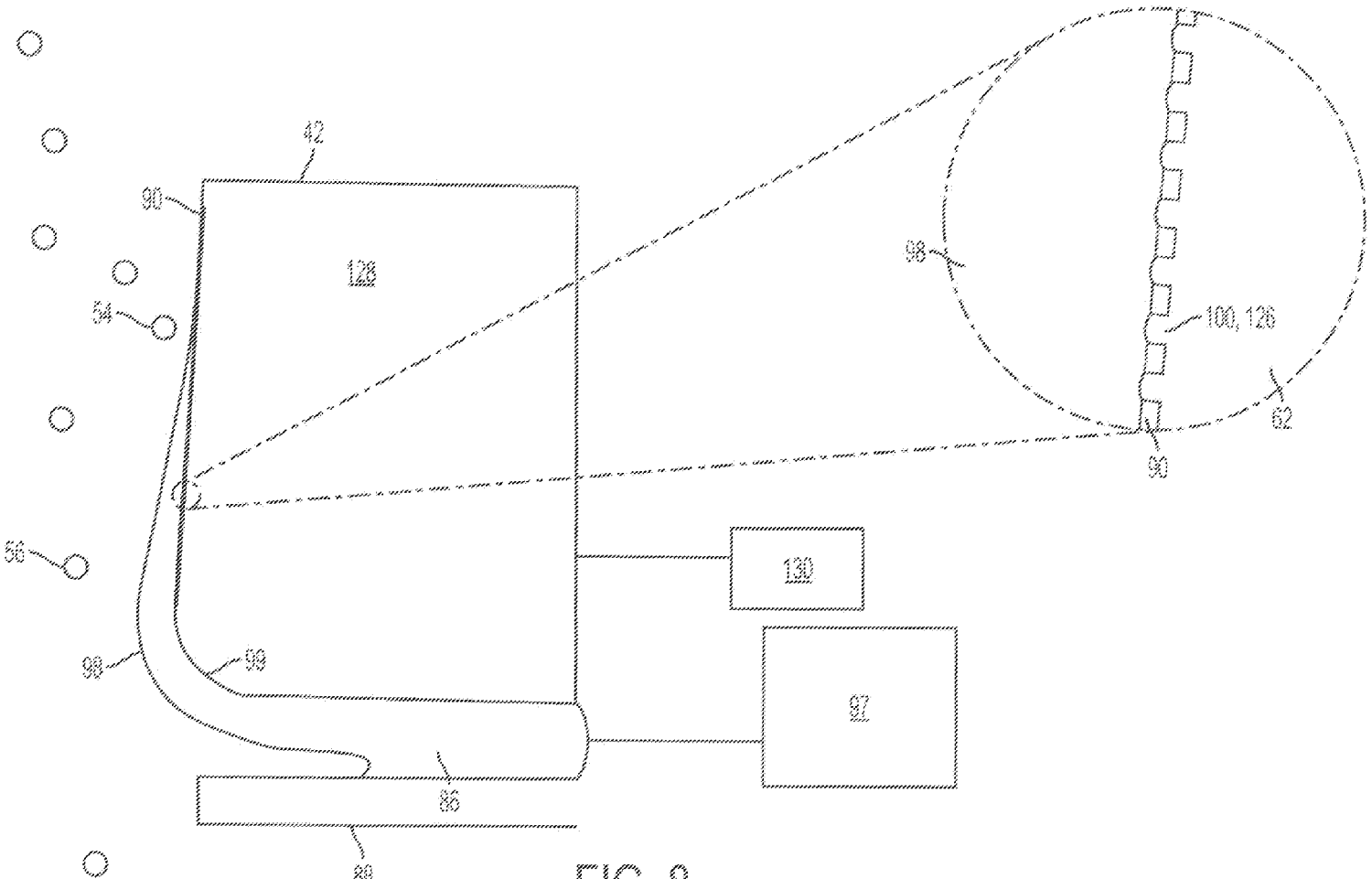
FIG. 8 is an isometric view of a portion of a catcher face with openings that are formed by air filled pores through the catcher face.

In another embodiment, shown in FIG. 8, openings 100 are created in the form of pores 126 that pass through the face 90 of the catcher to a chamber 128 within the catcher 42. The chamber 128 is connected to a pressure source 130. The pressure source keeps the chamber and the pores 128 filled with air or other gas so that the liquid flowing over the catcher face does not pass through the pores but rather rides on the air or gas 62 within the pores. Preferably, the approximate diameter of openings 100 is between 2 μm and ⅓ of the jet to jet spacing in the ink jet array (14 μm for a 600 jet per inch array). In this manner the liquid drag of liquid flowing on the catcher face can be reduced by air bearings formed from air filled pores in the catcher face.

With this embodiment, printhead maintenance procedures such as during startup and shutdown sequences can include steps where the air pressure applied to the chamber 128 is increased sufficiently to blow ink residue from the pores through the catcher face to prevent these pores from becoming clogged with dried ink residue. It is also anticipated that a cleaning fluid can be introduced into the chamber of the catcher to dissolve and displace ink from the pores. Pressurized air or other gas can then supplied to the chamber to displace the cleaning fluid from the pores once again establishing an air bearing. Pressurization of the opening is not limited to use with traditional start-up/shut-down methods, however. Fluids with very low surface tensions can additionally be used to clean the surface area of the catcher. Other cleaning processes including high-pressure spray methods, megasonic methods, and nucleation methods are also suitable for cleaning the catcher plate surface.

Figure 9:
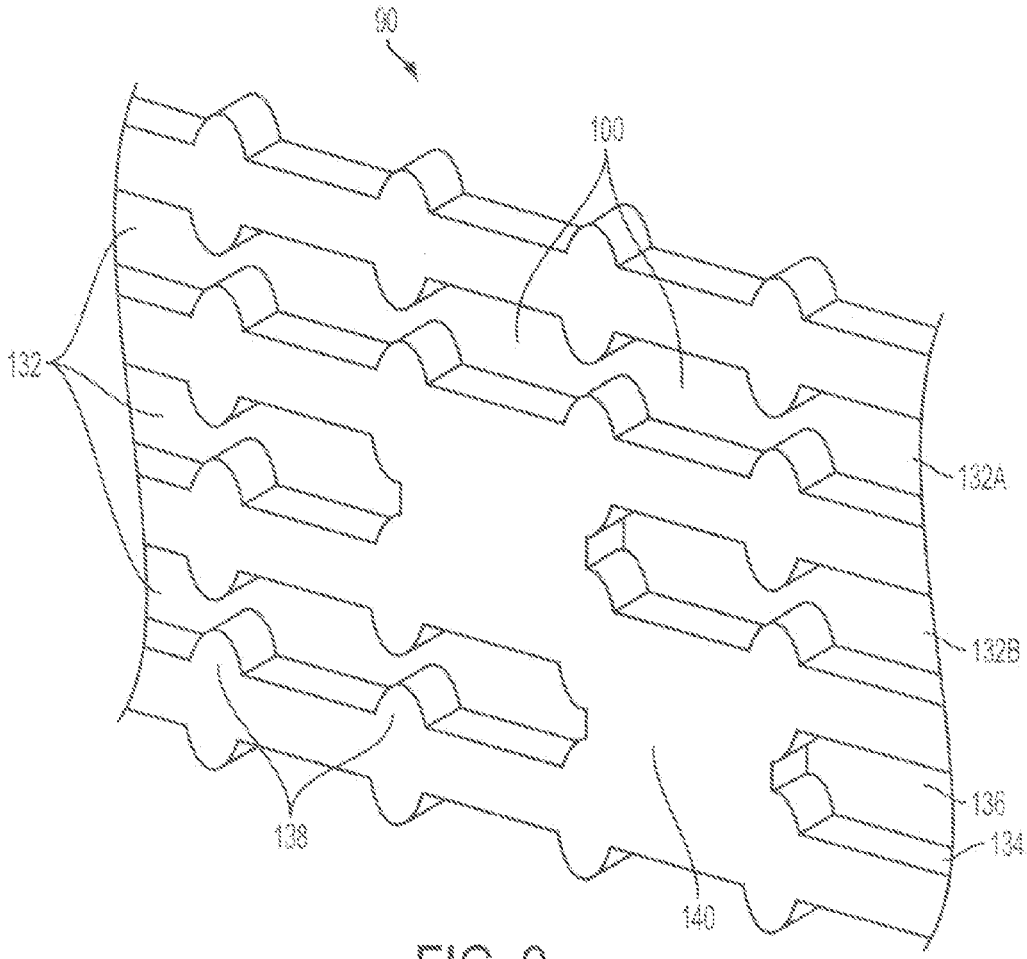
FIG. 9 is an isometric view a portion of the catcher face with openings that are formed by channels in the catcher face.

In still another embodiment, shown in FIG. 9, the opening 100 is formed by a plurality of channels 132 extending into the surface of the catcher face 90. The channel walls 134 and base 136 should be non-wettable for the liquids that are jetted in the ink jet printer. The channel width must be sufficiently small that air is retained in the openings 100 created by the channels 132. In one preferred embodiment, the approximate channel width is between 2 μm and ⅓ of the jet to jet spacing in the ink jet array (14 μm for a 600 jet per inch array). The depth 112 of the channels should be at least about two times the channel width. More preferably the depth of the channels is at least five times the channel width. Preferably the walls of the channel include wall features 138 that help to pin the air liquid interface along the length of the channel so that the liquid doesn't displace air from sections of the channel. The channels 132 can span the catcher face as suggested by the upper channel 132A. Alternatively, barriers 142 can terminate at least some of the channels 132B so that they don't span the catcher. If barriers are employed it is preferable that the barriers be offset from each other so that all portions of the ink film across the catcher face pass over at least some openings created by the channels. The channels in FIG. 9 are oriented perpendicular to the trajectory of undeflected drops. It is anticipated that other orientations such as approximately parallel or diagonal to the drop trajectory can also be employed. In one embodiment in addition to a first set of channels, there is a second set of channels that are not aligned parallel to the first set of channels such that at least some of channels of the first set intersect with channels of the second set. When the channels are oriented parallel to the drop trajectory the channel width must be less than one third the jet to jet spacing in width, and preferably there should be at least two channels for each jet to jet spacing. The narrow channel spacing in combination with the non-wettable walls of the channel keep the ink film from flowing within the channels but rather flowing over the air cushion formed within the channels.

The openings, in the form of depressions 108, gaps between micro-poles or free-standing pillars 116, pores 126, or channels on the catcher face can be manufactured directly on the catcher face 90 or they can be fabricated onto a separate piece that is attached as an insert on the catcher face. For example, when a silicon wafer is used for the catcher face, the openings can be created via silicon processing. According to one process, a photolithographic process such as those known in the art is used to mask off the land areas between openings. Deep Reactive Ion Etching (DRIE) is then used to etch into the silicon to create the recessed areas. The depth of the openings is controlled by the duration of the DRIE process. A non-wettable material is then deposited onto the walls and base of the openings. The etch mask may be employed to limit the deposition of the non-wettable material to the walls and base of the openings so that the non-wettable material is not applied to the land area between the openings. Silicon nitride is sufficiently non-wettable to be employed as the non-wettable material, but other materials that have higher contact angles such as Teflon or fluorinated compounds are anticipated to be useful. The etch mask is then removed from the land area between openings. Other processes can be used provided the process is sufficient to form the openings of the desired size and depth. It is anticipated that these openings could also be created by known chemical etching or electrochemical plating or material removal processes used in conjunction with known photoresist masking processes for metallic catcher faces.

As there is no need to reduce the liquid flow drag above the impact point at which the non-print drops strike the catcher face, the portion of the catcher face above the impact point need not be fabricated to include a plurality of openings for forming air bearings upon which liquid can flow. As mentioned above the liquid drag is reduced in front of an opening relative to the liquid drag in front of the land area between depressions, it is desirable to keep the land area between depressions to a minimum to maximize drag reduction. It is anticipated however that the density of openings on the catcher face, that is the spacing between the openings, can be varied to provide more control on the flow of liquid down the catcher face. For example, on the rounded edge 99 at the entrance of the liquid return duct 86, the density of openings might be different than density of openings high up on the catcher face. In the various embodiments, openings are formed in the catcher for forming air bearings upon which liquid can flow. This allows the liquid to flow with lower drag down the catcher face to the entrance of the liquid return duct 86. By so doing, the thickness of the liquid film on the catcher face can be reduced relative to the liquid film on a catcher face without the present invention.

The invention has been described in detail with particular reference to certain preferred embodiments thereof, but it will be understood that variations and modifications can be effected within the scope of the invention.

PARTS LIST

20 continuous ink jet printer system
22 image source
24 image processing unit
26 mechanism control circuits
28 device
30 printhead
32 recording medium
34 recording medium transport system
36 recording medium transport control system
38 micro-controller
40 reservoir
42 catcher
44 recycling unit
46 pressure regulator
47 channel
48 jetting module
49 nozzle plate
50 plurality of nozzles
51 heater
52 liquid
54 drops
56 drops
57 trajectory
58 drop stream
60 gas flow deflection mechanism
61 positive pressure gas flow structure
62 gas
63 negative pressure gas flow structure
64 deflection zone
66 small drop trajectory
68 large drop trajectory
72 first gas flow duct
74 lower wall
76 upper wall
78 second gas flow duct
82 upper wall
86 liquid return duct
88 plate
90 front face
92 positive pressure source
94 negative pressure source
96 wall
97 negative pressure source
98 film of ink
99 Rounded edge
100 opening
102 air cushion
104 wall of opening
106 base of opening
108 depression
110 land area
112 depth
114 diameter
116 micro-poles
118 gaps
120 ends of micro-poles
122 sides
124 base surface
126 pore
128 chamber
130 positive pressure source
132 channel
134 wall
136 channel base
138 wall feature
140 channel width

The invention claimed is:

1. A catcher comprising:

a liquid return duct that receives liquid; and a liquid drop contact face along which liquid, from an impinging liquid drop, flows toward the liquid return duct, the liquid drop contact face including an opening through which the liquid does not flow, the opening trapping air to create an air cushion between the flowing liquid and the liquid drop contact surface upon which the liquid flows after the liquid drop impinges the drop contact face.

2. The catcher of claim 1, the opening being at least partially bounded by a non-wettable wall.

3. The catcher of claim 1, wherein the opening includes spaces located around free standing pillars extending from the drop contact face.

4. The catcher of claim 1, wherein the opening includes a plurality of depressions extending into the drop contact face.

5. The catcher of claim 1, wherein the opening includes a plurality of channels extending into the drop contact face.

6. The catcher of claim 5, the plurality of channels being a first set of channels, wherein the opening includes a second set of channels that are not aligned parallel to the first set of channels.

7. The catcher of claim 1, wherein the opening forms a two dimensional array of openings.

8. The catcher of claim 1, the opening including a pore in fluid communication with a chamber, further comprising:

a pressure source that provides a gas flow to the chamber that displaces the liquid from the pore to create the air cushion, the pressure source being in fluid communication with the pore through the chamber.

9. The catcher of claim 1, the liquid drops being formed by jets of an ink jet array, the jets having a jet to jet spacing, the opening including a width, wherein the opening width is between 2 μm and ⅓ of the jet to jet spacing in the ink jet array.

10. The catcher of claim 1, the opening having a depth and a width, wherein the opening depth is at least two times the opening width.

11. The catcher of claim 1, wherein the opening depth is at least five time the opening width.

12. A method of printing comprising:

providing a jetting module including a nozzle in fluid communication with a liquid source;

causing liquid to be jetted through the nozzle;

causing liquid drops to be formed from the liquid that is jetted through the nozzle;

deflecting at least some of the liquid drops using a deflection mechanism;

providing a catcher including a liquid return duct that receives liquid and a liquid drop contact face along which liquid, from an impinging liquid drop, flows toward the liquid return duct, the liquid drop contact face including an opening through which the liquid does not flow;

trapping air in the opening to create an air cushion between the flowing liquid and the liquid drop contact surface; and causing some of the liquid drops to flow along the air cushion after the liquid drop impinges the drop contact face while other drops are permitted to contact a print media.

13. The method of claim 12, wherein the opening is at least partially bounded by a non-wettable wall.

14. The method of claim 12, wherein the opening includes space between free standing pillars extending from the drop contact face.

15. The method of claim 12, wherein the opening includes a plurality of depressions extending into the drop contact face.

16. The method of claim 12, wherein the opening includes a plurality of channels extending into the drop contact face.

17. The method of claim 12, wherein the opening includes a two dimensional array of openings.

18. The method of claim 12, the opening including a pore in fluid communication with a chamber, further comprising:

providing a pressure source in fluid communication with the pore through the chamber; and displacing the liquid from the pore to create the air cushion using a gas flowing from the pressure source to the chamber.

19. The method of claim 12, the opening having a depth and a width, wherein the opening depth is at least two times the opening width.

* * * * *